US005595491A

United States Patent [19]

May

[11] Patent Number: 5,595,491

[45] Date of Patent: Jan. 21, 1997

[54] 240 VOLT RECEPTACLE MODULE FOR MODULAR ELECTRICAL SYSTEM

[76] Inventor: Lindy L. May, P.O. Box 399, Strafford, Mo. 65757

[21] Appl. No.: 595,184

[22] Filed: Feb. 1, 1996

[51] Int. Cl.[6] ..... H01R 4/66

[52] U.S. Cl. ..... 439/106; 439/535; 439/658

[58] Field of Search ..... 439/106, 535, 439/658, 686, 689, 690, 95, 108

[56] References Cited

U.S. PATENT DOCUMENTS

| | | | |
|---|---|---|---|
| 3,489,981 | 1/1970 | Corl et al. | 439/425 |
| 4,025,139 | 5/1977 | Martucci | 439/106 |
| 5,117,122 | 5/1992 | Hogarth et al. | 439/535 |
| 5,281,154 | 1/1994 | Comerci et al. | 439/535 |

*Primary Examiner*—Gary F. Paumen

*Assistant Examiner*—T. C. Patel

[57] ABSTRACT

A 240 volt electrical circuit comprised of modular components which quickly assemble in a manner such that all wiring is completed in the electrical box prior to installing the 240 volt receptacle module, thereby eliminating the need for extra length wires in the electrical box and the cumbersome wiring practices associated with conventional 240 volt electrical circuits. The 240 volt receptacle module plugs into the prewired electrical box, thereby providing quick and easy removal and replacement of the module in the event of failure. The 240 volt electrical circuit is self-configured by simply assembling the modular components. A dedicated earth ground is self-distributed to each electrical component with no effort on the part of the installer, thereby providing safer electrical circuits. The 240 volt electrical circuit uses a 4-conductor cable which has a cable sheath extruded to a specific exterior profile to insure proper connection with the electrical box, thereby assuring proper configuration of the 240 volt electrical circuit.

5 Claims, 17 Drawing Sheets

240 VOLT RECEPTACLE MODULE FOR MODULAR ELECTRICAL SYSTEM

CROSS-REFERENCE

Prior aplication Ser. No. 08/518,747

Prior application filing date: Aug. 24, 1995

Prior application relationship: The wallbox and 4-conductor electrical cable disclosed in the prior application are also an integral part of this application.

FIELD OF THE INVENTION

The present invention relates to the field of electrical components and more particularly to those electrical components which constitute common residential electrical circuits.

BACKGROUND AND SUMMARY OF THE INVENTION

Conventional 240 volt electrical circuits consist of components which require time-consuming, cumbersome wiring practices. The conventional 240 volt receptacles must be wired prior to inserting them into their respective electrical box. This requires that the wires be of extra length to facilitate this wiring practice. This excess wire must then be stuffed into the electrical box as the electrical device is installed. The process of stuffing the wires and the electrical device into the electrical box results in the wires exerting a pulling force on their points of termination, creating the possibility of wires coming loose. This contributes to faulty circuits and potential fire hazards.

It is thus a principal object of this invention to provide a 240 volt electrical circuit which utilizes modular electrical components in which all the wiring is completed in the electrical box prior to the 240 volt electrical receptacle being installed; thereby eliminating the need for the extra length wires and the cumbersome wiring practices associated with conventional 240 volt electrical circuits.

Another object of this invention is to provide a 240 volt electrical circuit which sell-distributes a dedicated earth ground to each electrical component with little or no effort on the part of the installer, thereby eliminating negligence in this wiring practice and reducing potential fire hazards and risk of electrical shock to users of these circuits.

It is a further object of the present invention to provide a 240 volt electrical circuit which utilizes modular components which assemble quickly and easily in a specific manner so as to self-configure the 240 volt electrical circuit by simply selecting the proper components.

A still further object of this invention is to provide a 240 volt electrical circuit which utilizes modular electrical components in which the 240 volt electrical receptacle simply plugs into the prewired electrical box, thereby permitting easy removal and replacement.

These and other objects will become apparent hereinafter.

DESCRIPTION OF THE PREFERRED EMBODIMENTS

Figure 1:
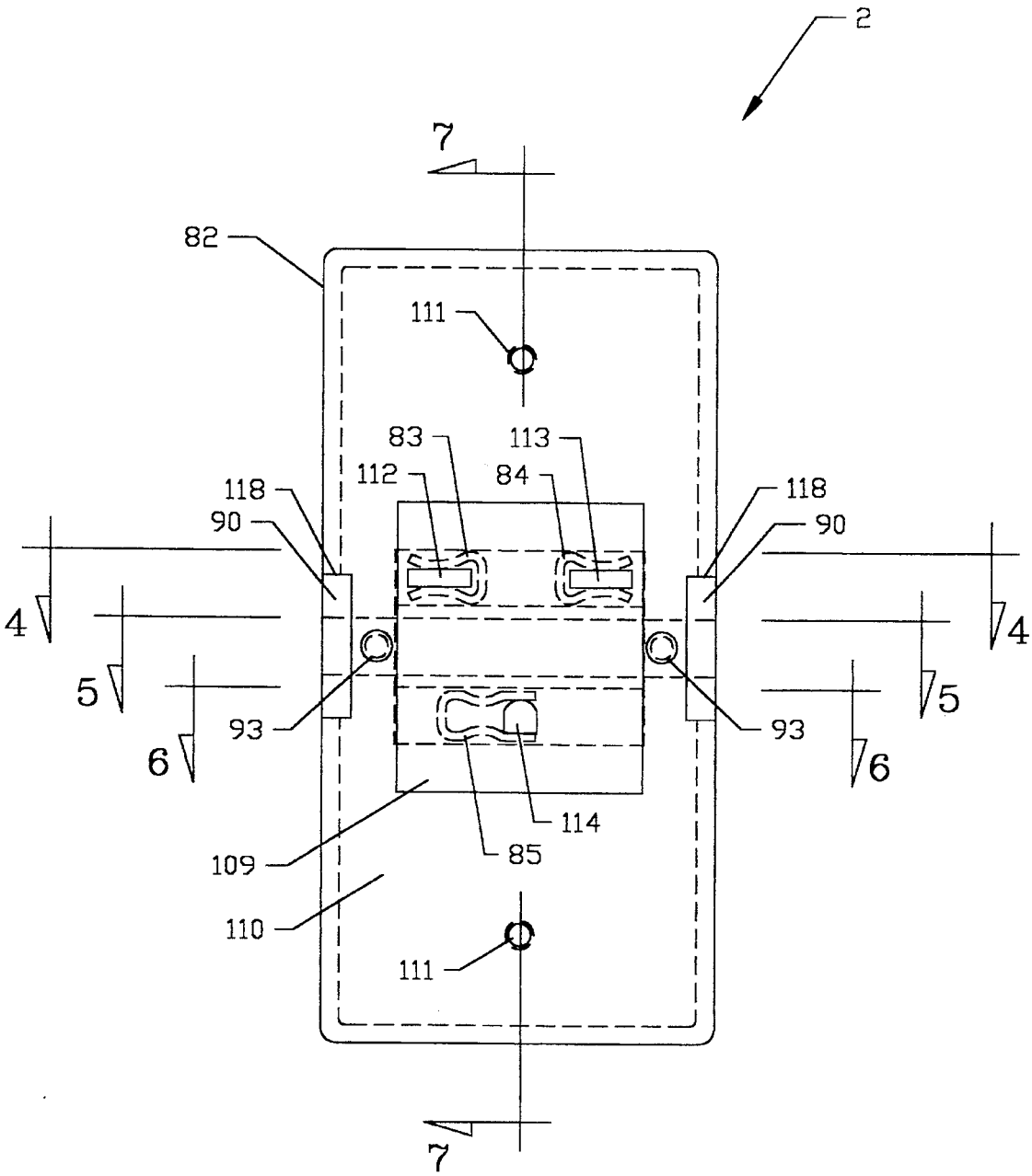
FIG. 1 is a front elevation view of the 240 volt receptacle module.
Figure 2:
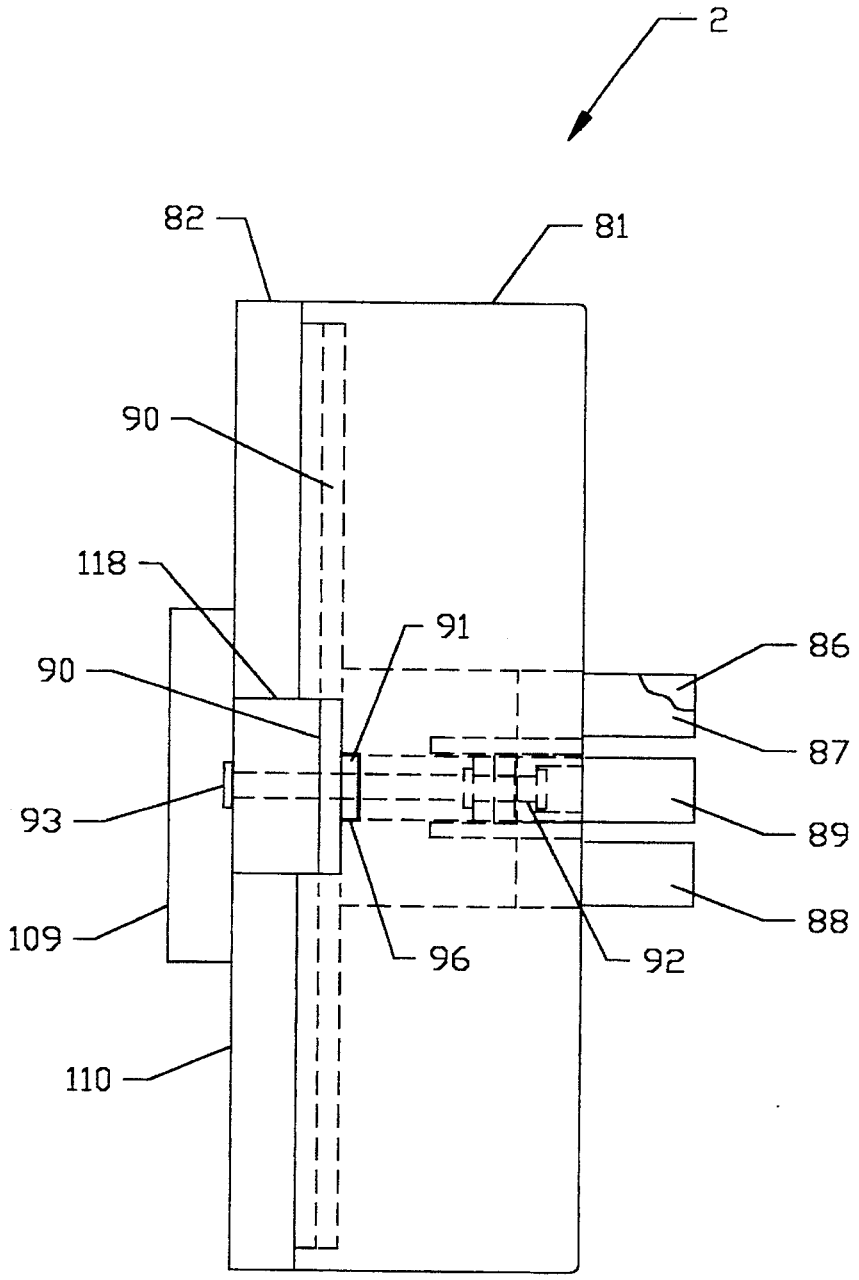
FIG. 2 is a side elevation view of the 240 volt receptacle module.
Figure 3:
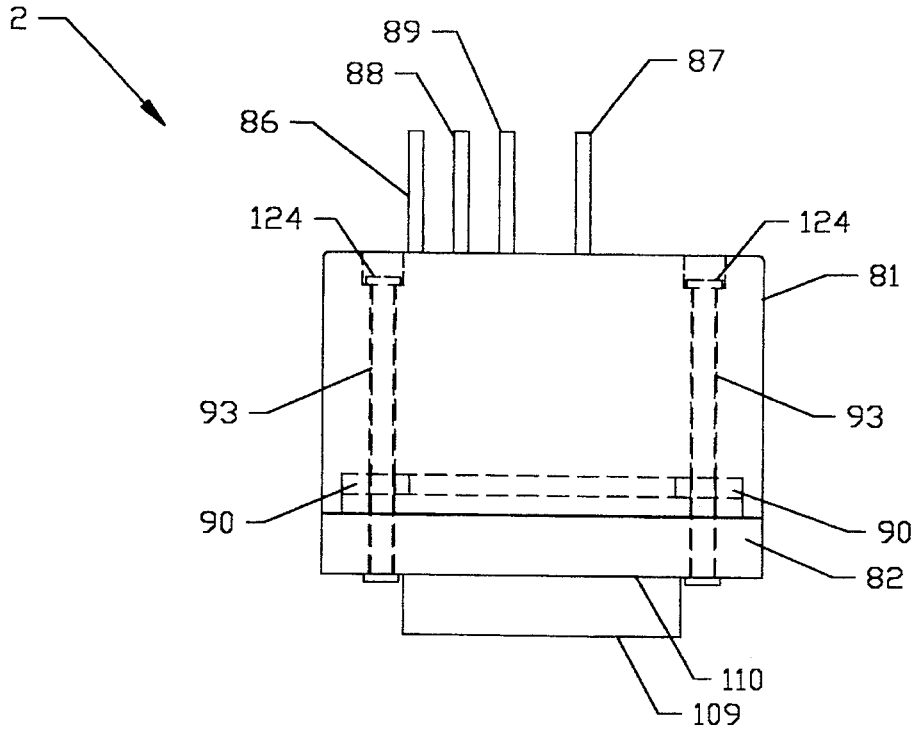
FIG. 3 is a plan view of the 240 volt receptacle module.
Figure 4:
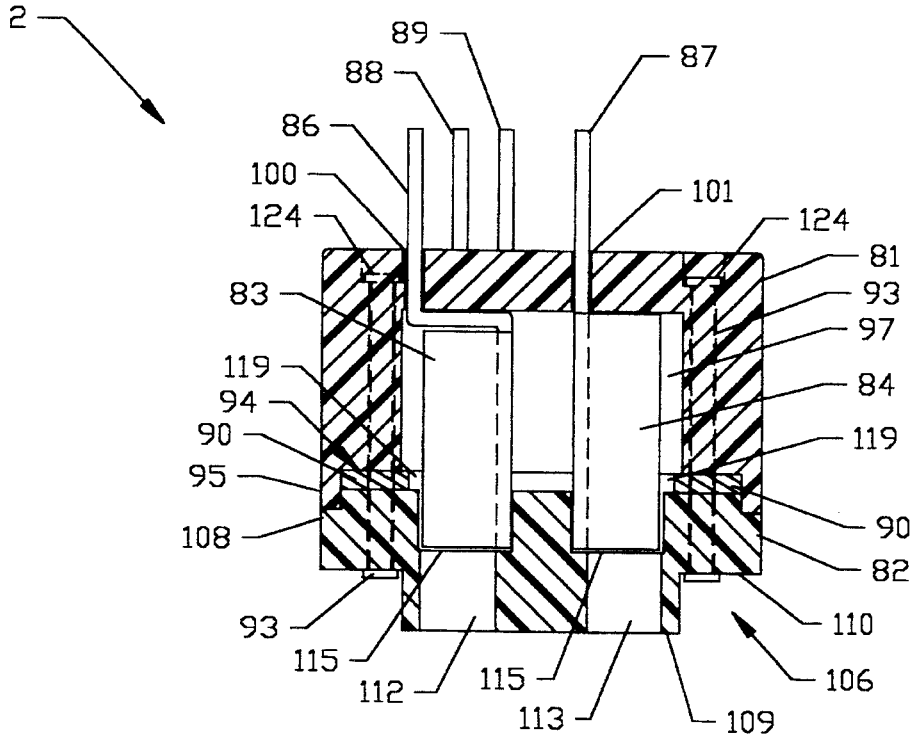
FIG. 4 is a horizontal section view taken along line 4—4 of FIG. 1.
Figure 5:
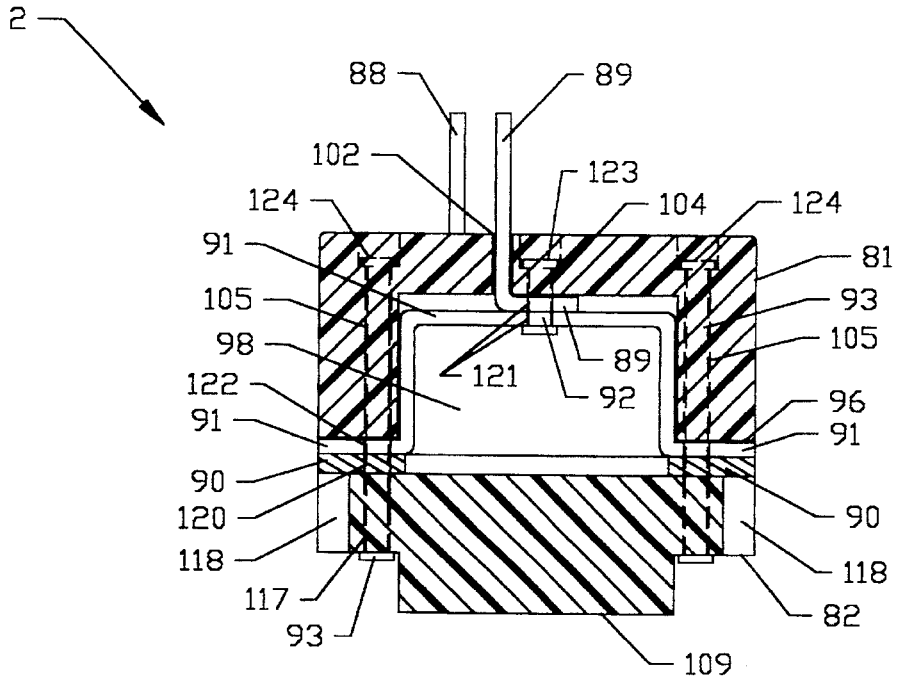
FIG. 5 is a horizontal section view taken along line 5—5 of FIG. 1.
Figure 6:
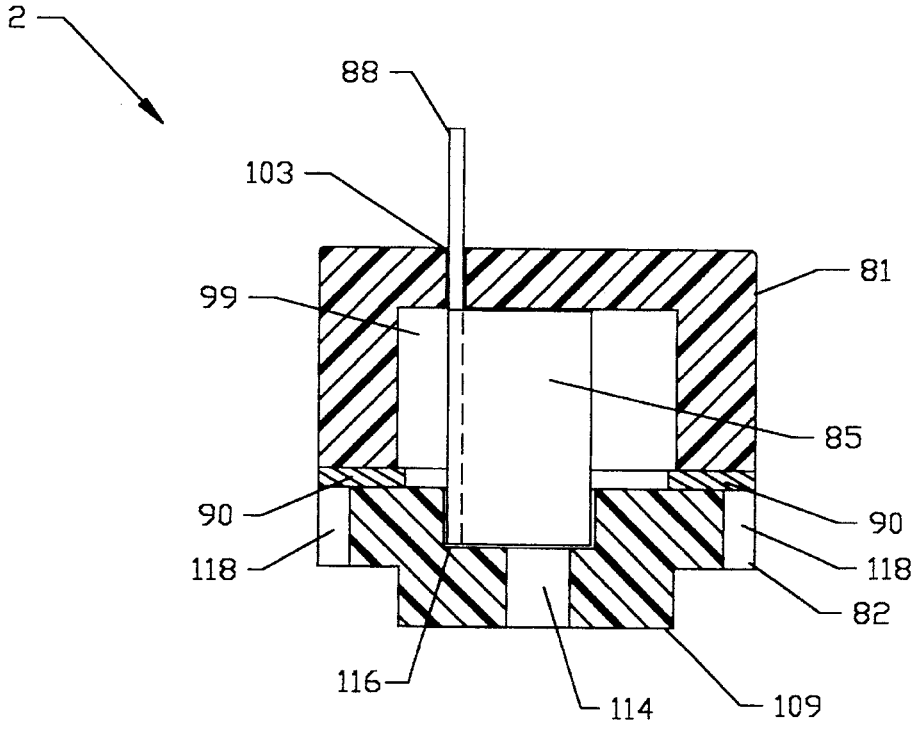
FIG. 6 is a horizontal section view taken along line 6—6 of FIG. 1.
Figure 7:
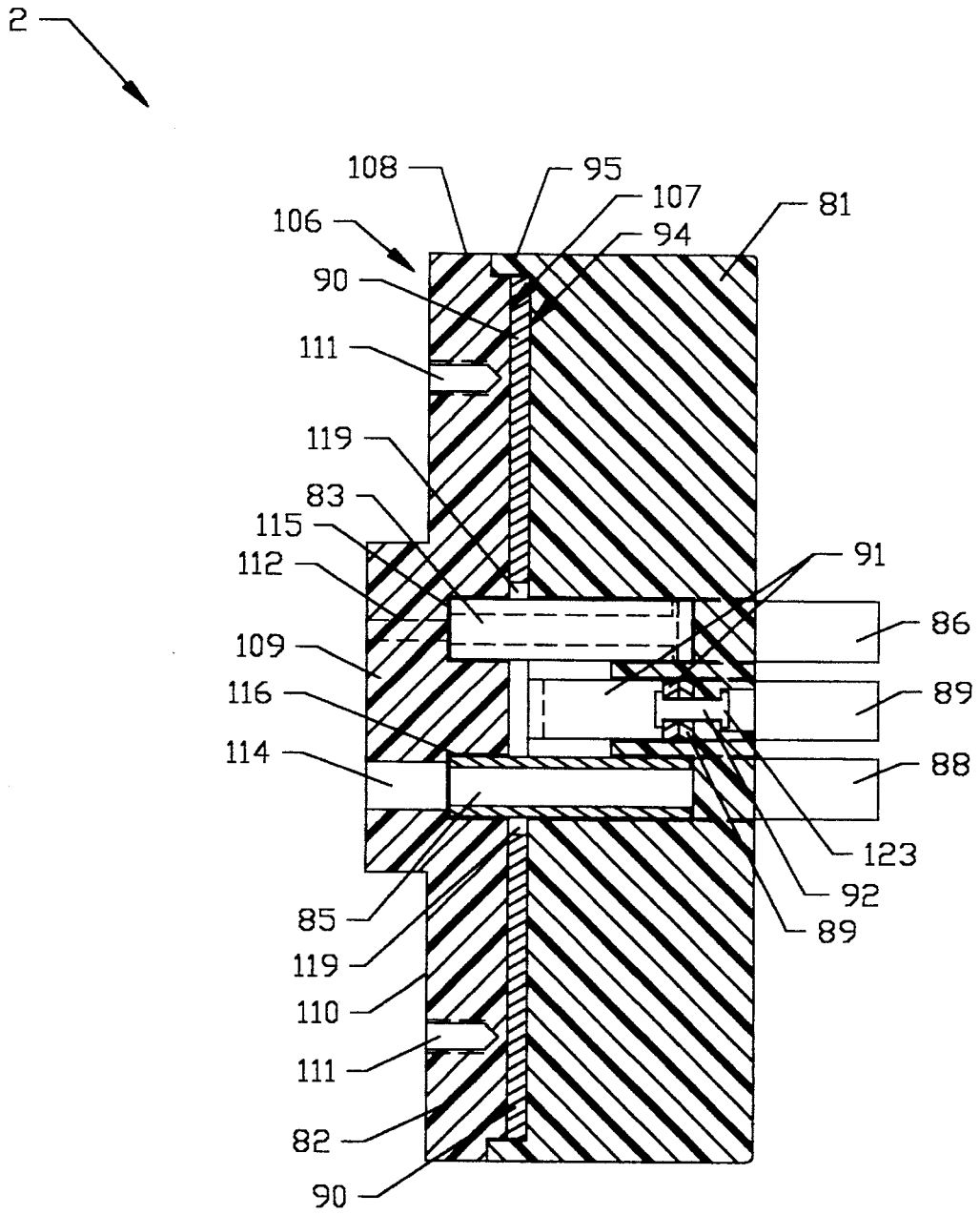
FIG. 7 is a vertical section view taken along line 7—7 of FIG. 1.
Figure 8:
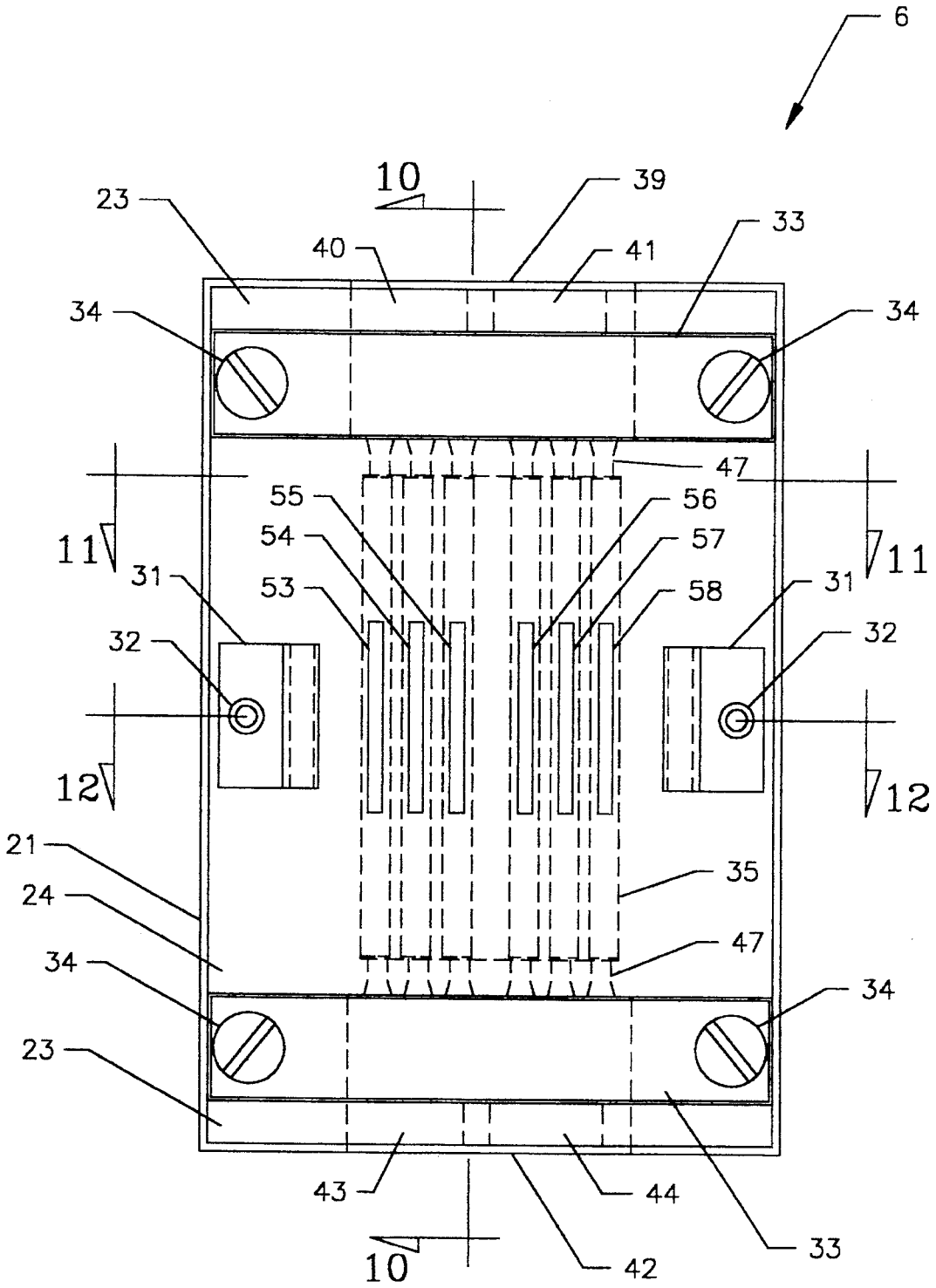
FIG. 8 is a front elevation view of the wallbox.
Figure 9:
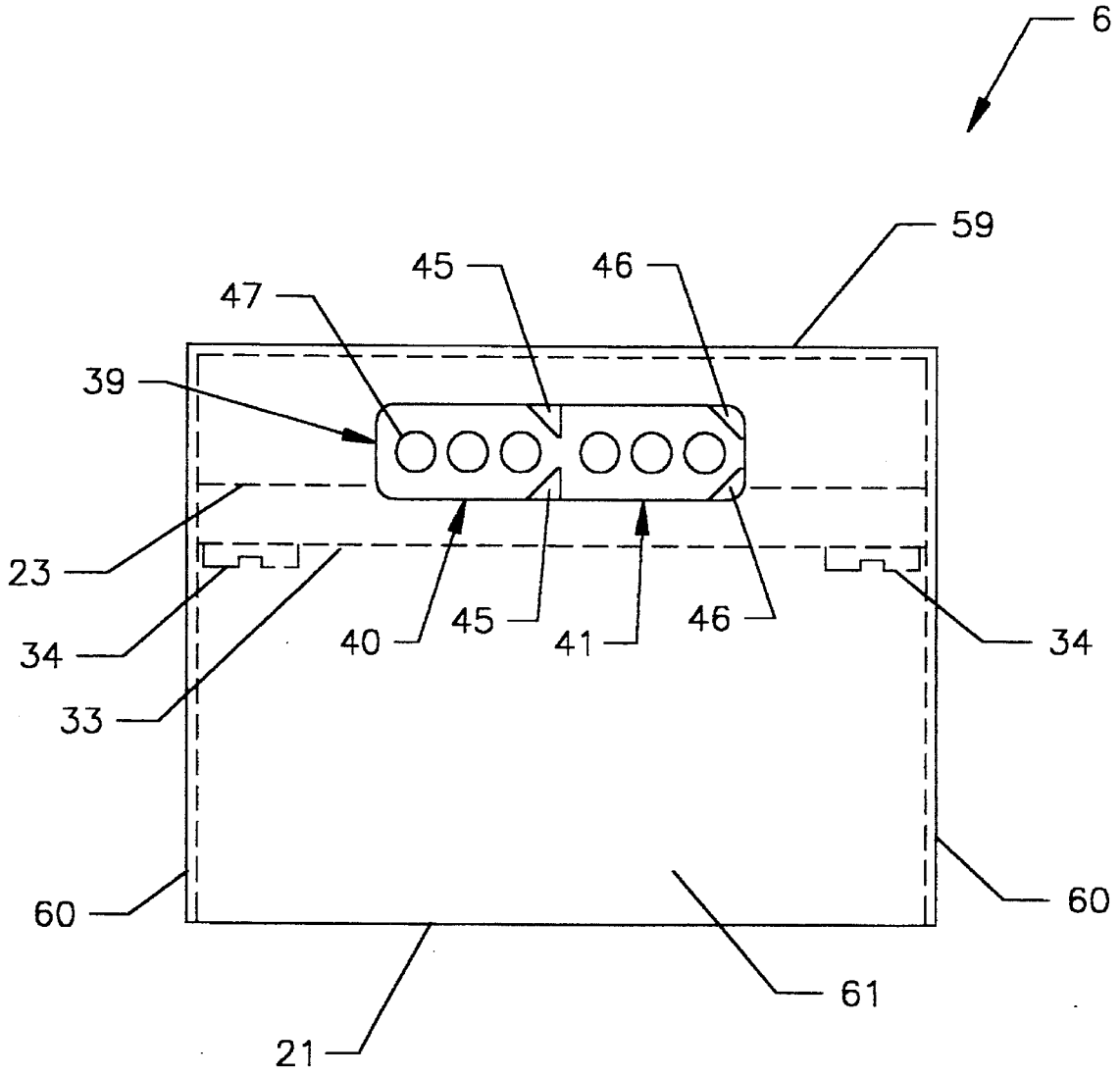
FIG. 9 is a plan view of the wallbox.

Referring to FIGS. 1 through 7, there is provided a 240 volt receptacle module 2. The 240 volt receptacle module 2 is comprised of eleven components which are the module base 81, module cover 82, left positive plug adapter 83, right positive plug adapter 84, neutral plug adapter 85, grounding plate 90, grounding bar 91, ground blade conductor 89, short rivet 92, and two long rivets 93.

The module base 81 is constructed of plastic, or otherwise a non-conductive material. The module base 81 provides three blade conductor cavities 97, 98, 99. The upper blade conductor cavity 97 is provided with two blade slots 100, 101; the middle blade conductor cavity 98 is provided with one blade slot 102; and the lower blade conductor cavity 99 is provided with one blade slot 103. The middle blade conductor cavity 98 is also provided with one rivet hole 104. The front surface 94 of the module base 81 is recessed relative to the outer edges 95 to accommodate the grounding plate 90 and the module cover 82. The front surface 94 contains two recessed cavities 96 to accommodate the grounding bar 91. The module base 81 also provides two rivet holes 105.

The module cover 82 is also constructed of plastic, or otherwise a non-conductive material. The front side 106 of the module cover 82 provides a wallplate mounting surface 110 which is recessed relative to the receptacle face 109. The receptacle face 109 provides a left positive plug slot 112, a right positive plug slot 113, and a neutral plug slot 114. The plug slots 112, 113, 114 are located to accommodate a standard 240 volt plug. Various standard 240 volt plugs are available and the arrangement of the plug slots 112, 113, 114 is selected for the purposes of this disclosure and it is not intended to imply that the present invention is restricted to this arrangement. The back side 107 of the module cover 82 provides two positive plug adapter cavities 115 and a neutral plug adapter cavity 116. The outer edges 108 of the module cover 82 are recessed on the back side 107 to accommodate the receptacle module base 81. The outer edges 108 are also provided with two notches 118. The module cover 82 provides two rivet holes 117 to accommodate the long rivets 93, and two threaded holes 111 to accommodate the wall-plate mounting screws 128.

The positive plug adapters 83, 84, neutral plug adapter 85, grounding bar 91, and ground blade conductor 89 are each of a one-piece formed construction as shown in FIGS. 4 through 7, and constructed of a copper alloy, or otherwise a conductive material. The positive plug adapters 83, 84 and neutral plug adapter 85 are each provided with a blade conductor 86, 87, 88. The ground blade conductor 89 is provided with one rivet hole 121. The grounding bar 91 is provided with one rivet hole 121 in the center and one rivet hole 122 located at each of the two ends.

The grounding plate 90 is constructed of steel and shaped to accommodate the receptacle module base 81. The grounding plate 90 provides one large opening 119 to avoid interference with the plug adapters 83, 84, 85. Two rivet holes 120 are provided to accommodate the long rivets 93.

Assembly of the 240 volt receptacle module 2 is performed as follows. The ground blade conductor 89 is fully inserted into the middle blade-conductor cavity 98 of the module base 81 as the blade protrudes through the blade slot 102. The grounding bar 91 is then inserted into the middle blade-conductor cavity 98 until it is fully seated against the ground blade conductor 90. A short rivet 92 is then inserted through the rivet hole 121 of the grounding bar 91, through the rivet hole 121 of the ground blade conductor 90, and through the rivet hole 104 of the module base 81 where the rivet head 123 is expanded as it draws the components tightly together. The left positive plug adapter 83 is fully inserted into the upper blade-conductor cavity 97 of the module base 81 as the blade conductor 86 protrudes through the left blade slot 100. Likewise, the right positive plug adapter 84 is fully inserted into the upper blade-conductor cavity 97 as the blade conductor 87 protrudes through the right blade slot 101. The neutral plug adapter 85 is then inserted into the lower blade-conductor cavity 99 as the blade conductor 88 protrudes through the blade slot 103. The grounding plate 90 is then inserted into the module base 81 until it is seated against the front surface 94. The module cover 82 is then placed onto the module base 81 until it is seated against the grounding plate 90. Each of the two long rivets 93 are inserted through the rivet holes 117 of the module cover 82, through the rivet holes 120 in the grounding plate 90, through the rivet holes 122 in the grounding bar 87, and through the rivet holes 105 in the module base 81 where the rivet head 124 is expanded as it draws the components tightly together and secures the 240 volt receptacle module 2 as one assembly.

Referring to FIGS. 8 through 12, there is provided a wallbox 6. The two principal components of the wallbox 6 are the electrical box 21 and the wiring module 22. The wiring module 22 is comprised of a base 23; six wire adapters 25, 26, 27, 28, 29, 30; a cover 24; two spring clips 31; two rivets 32; two cable clamps 33; and four cable clamp screws 34.

The wiring module base 23 is constructed of plastic, or otherwise a nonconductive material. A cable port 39, 42 is provided at the top end 37 and the bottom end 38 of the wiring module base 23. Each cable port 39, 42 is rectangular shaped and contains two center-projections 45 and two end-projections 46 to create a specific interior profile. The two center-projections 45 divide the cable port 39, 42 into a left half 40, 43 and a right half 41, 44. The wiring module base 23 provides six cavities 35 which contain and separate the six wire adapters 25, 26, 27, 28, 29, 30. A wire entrance hole 47 is provided at each end 36 of each wire adapter cavity 35. The wiring module base 23 also provides two rivet holes 48 and four threaded holes 49 to accommodate the rivets 32 and the cable clamp screws 34, respectively.

The wire adapters 25, 26, 27, 28, 29, 30 are each of a one-piece formed construction and constructed of a copper alloy, or otherwise a conductive material. Each wire adapter 25, 26, 27, 28, 29, 30 provides a wire pressure-socket 67 at each end and a blade pressure-socket 70 in the center. The wire pressure-sockets 67 are created by two opposing tabs 68 which are formed closely together. The tabs 68 flex as they exert pressure on a wire that is larger than the space between the tabs 68, as the wire is inserted. The tabs 68 are each provided with an indentation 69 to provide maximum contact with the wire. The blade pressure-sockets 70 are created by a tab 71 which is formed opposing and closely together with the wire adapter sidewall 66. A slot 72 is provided in the wire adapters 25, 26, 27, 28, 29, 30 to permit a conductor blade to be inserted between the tab 71 and the wire adapter sidewall 66. The tab 71 flexes as it exerts pressure on a conductor blade that is larger than the space between the tab 71 and the wire adapter sidewall 66 as the conductor blade is inserted.

The wiring module cover 24 is constructed of plastic, or otherwise a non-conductive material. The back side 51 of the wiring module cover 24 provides six cavities 50 which contain and separate the six wire adapters 25, 26, 27, 28, 29, 30. The wiring module cover 24 has six blade slots 53, 54, 55, 56, 57, 58 located in alignment with the slots 72 in the six wire adapters 25, 26, 27, 28, 29, 30. The wiring module cover 24 also provides two rivet holes 52 to accommodate the rivets 32.

The two spring clips 31 are constructed of spring steel to provide a flexible nature and are provided with one rivet hole 73. The two cable clamps 33 may be constructed of aluminum or plastic and are provided with ridges 76 to increase the clamping effectiveness.

The electrical box 21 may be constructed of steel or plastic. A cable hole 65 is provided in the top end 61 and bottom end 62 of the electrical box 21 and located in alignment with the cable ports 39, 42 of the wiring module base 23. Two rivet holes 63 are provided in the back wall 59 of the electrical box 21 to accommodate the rivets 32. Two mounting holes 64 are provided in each sidewall 60 of the electrical box 21 mounting purposes.

Figure 10:
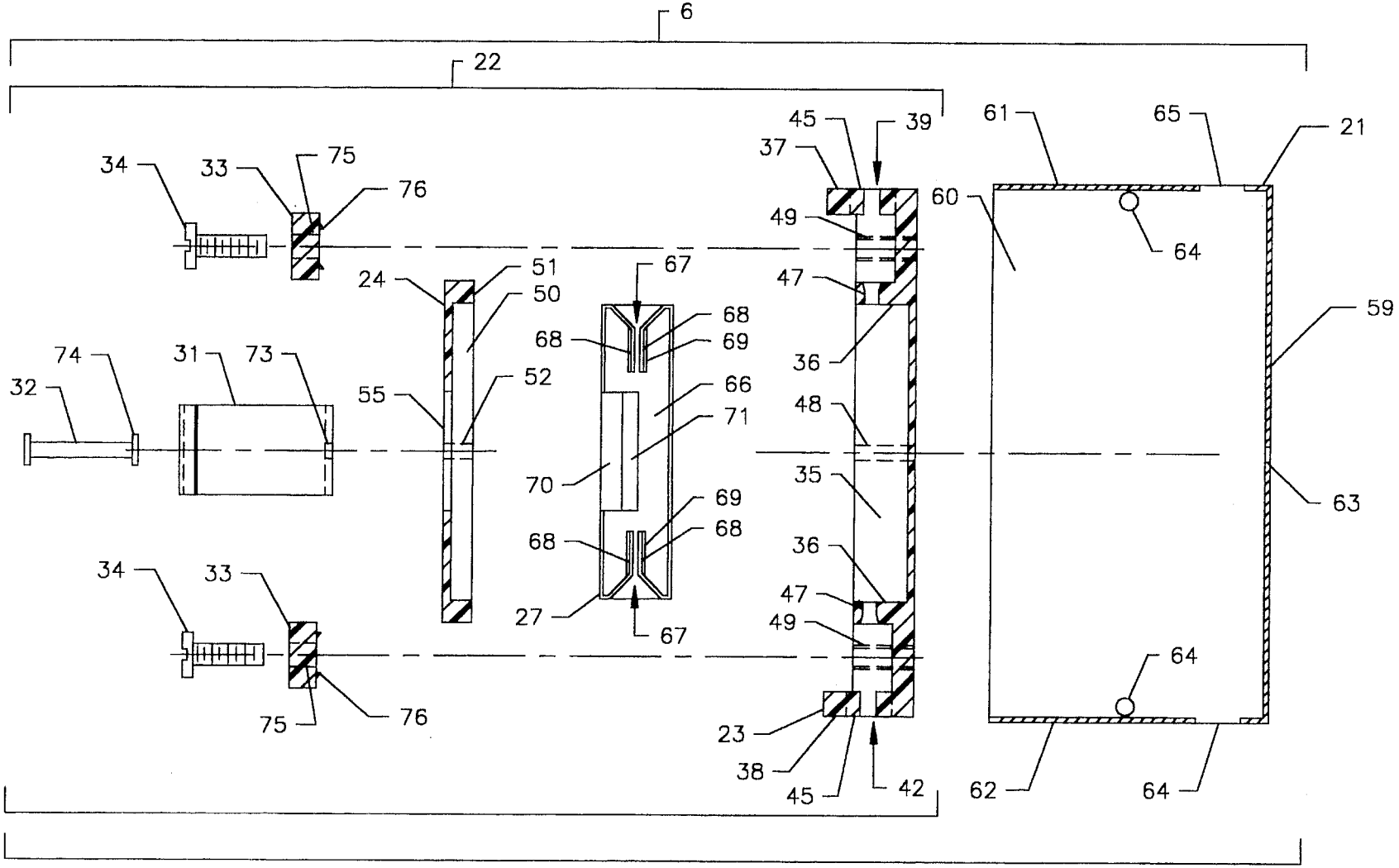
FIG. 10 is a vertical section view taken along line 10—10 of FIG. 8 shown in exploded form.
Figure 11:
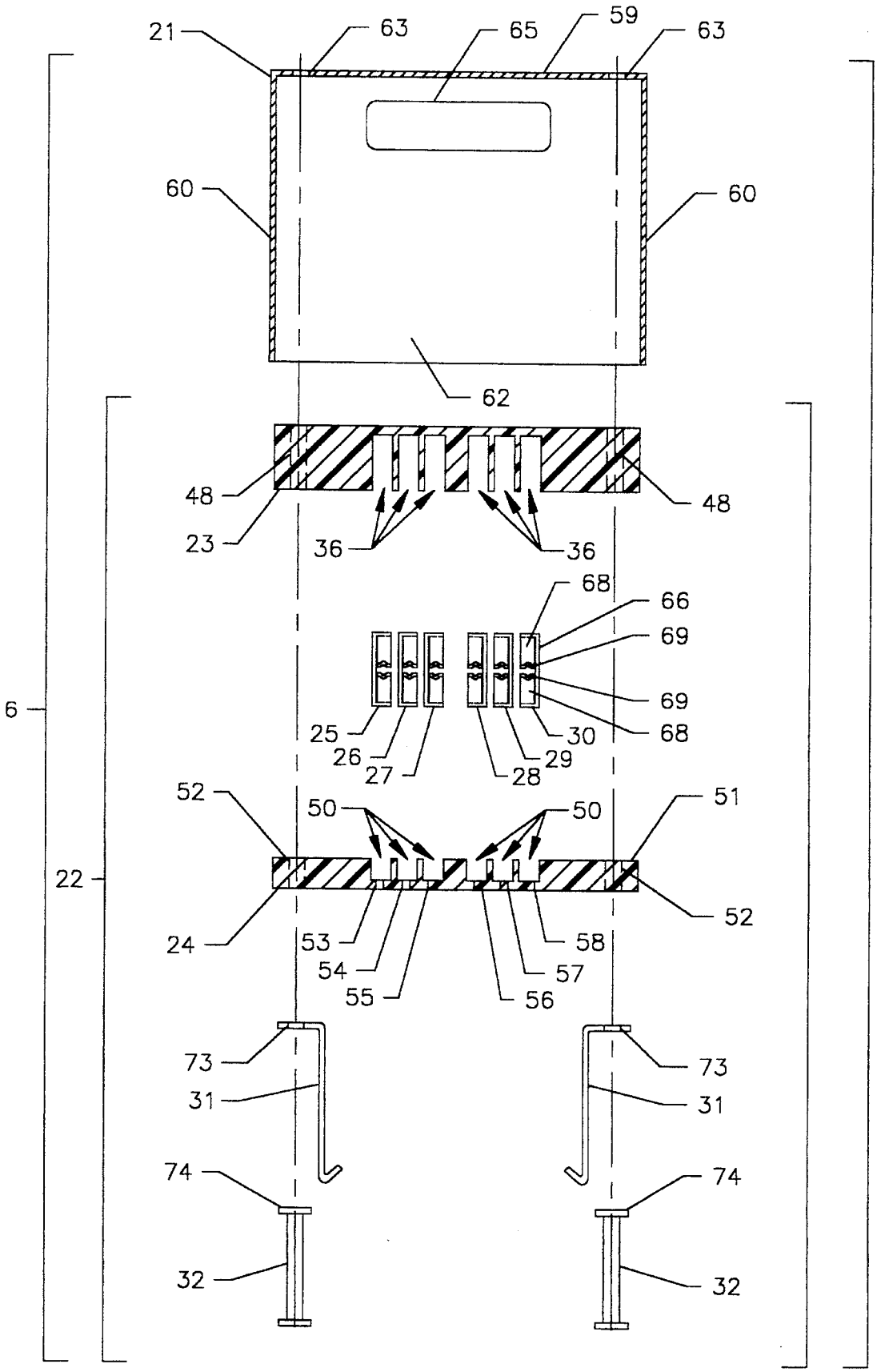
FIG. 11 is a horizontal section view taken along line 11—11 of FIG. 8 shown in exploded form.
Figure 12:
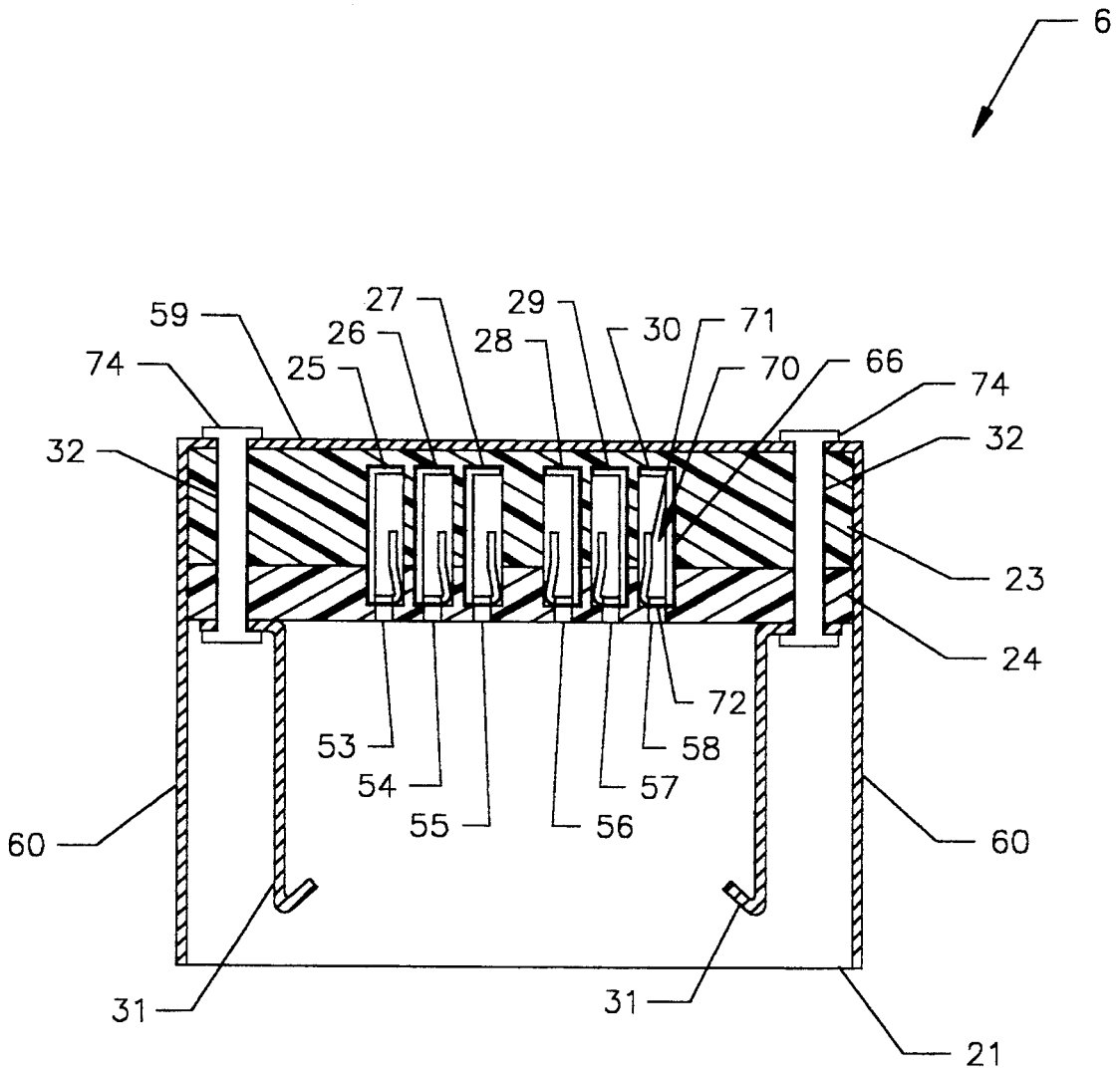
FIG. 12 is a horizontal section view taken along line 12—12 of FIG. 8.

Assembly of the wallbox 6 is easily seen in FIGS. 10 and 11. The wiring module base 23 is inserted into the electrical box 21. The six wire adapters 25, 26, 27, 28, 29, 30 are positioned into the wire adapter cavities 35 of the wiring module base 23. The wiring module cover 24 is then placed on top of the wiring module base 23. The rivets 32 are inserted through the rivet holes 73 of the spring clips 31, through the rivet holes 52 of the wiring module cover 24, through the rivet holes 48 of the wiring module base 23, and through the rivet holes 63 of the electrical box 21 where the rivet head 74 is expanded as it draws the components tightly together and secures the wallbox 6 as one assembly. Two of the four screws 34 are inserted through the mounting holes 75 of each cable clamp 33 and into the threaded holes 49 of the wiring module base 23.

Figure 13:
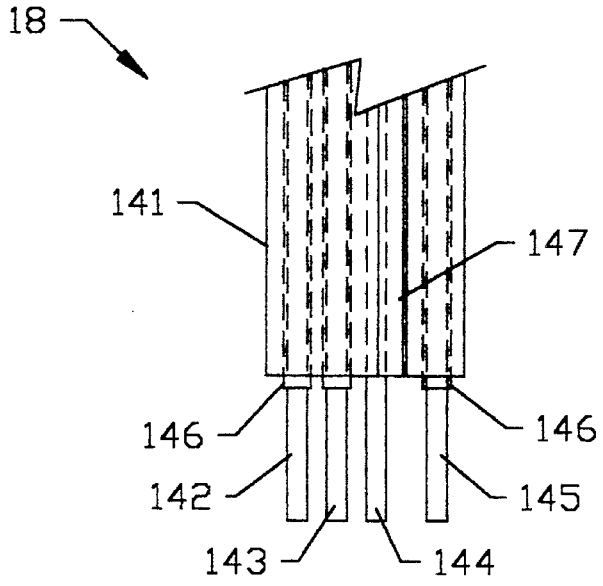
FIG. 13 is a front elevation view of the 4-conductor cable.
Figure 14:
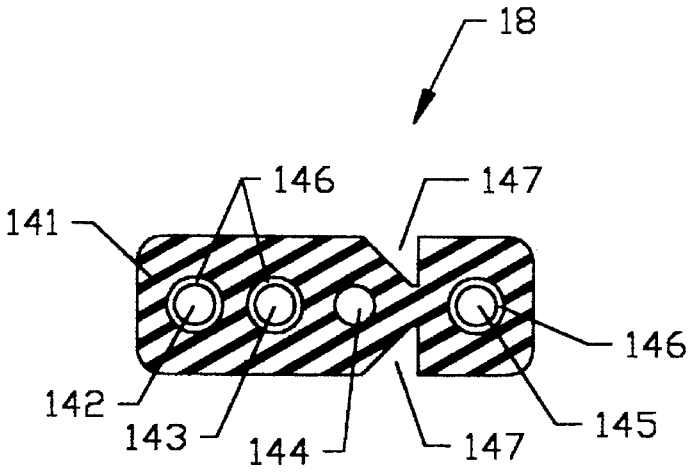
FIG. 14 is a cross-section view of the 4-conductor cable.
Figure 15:
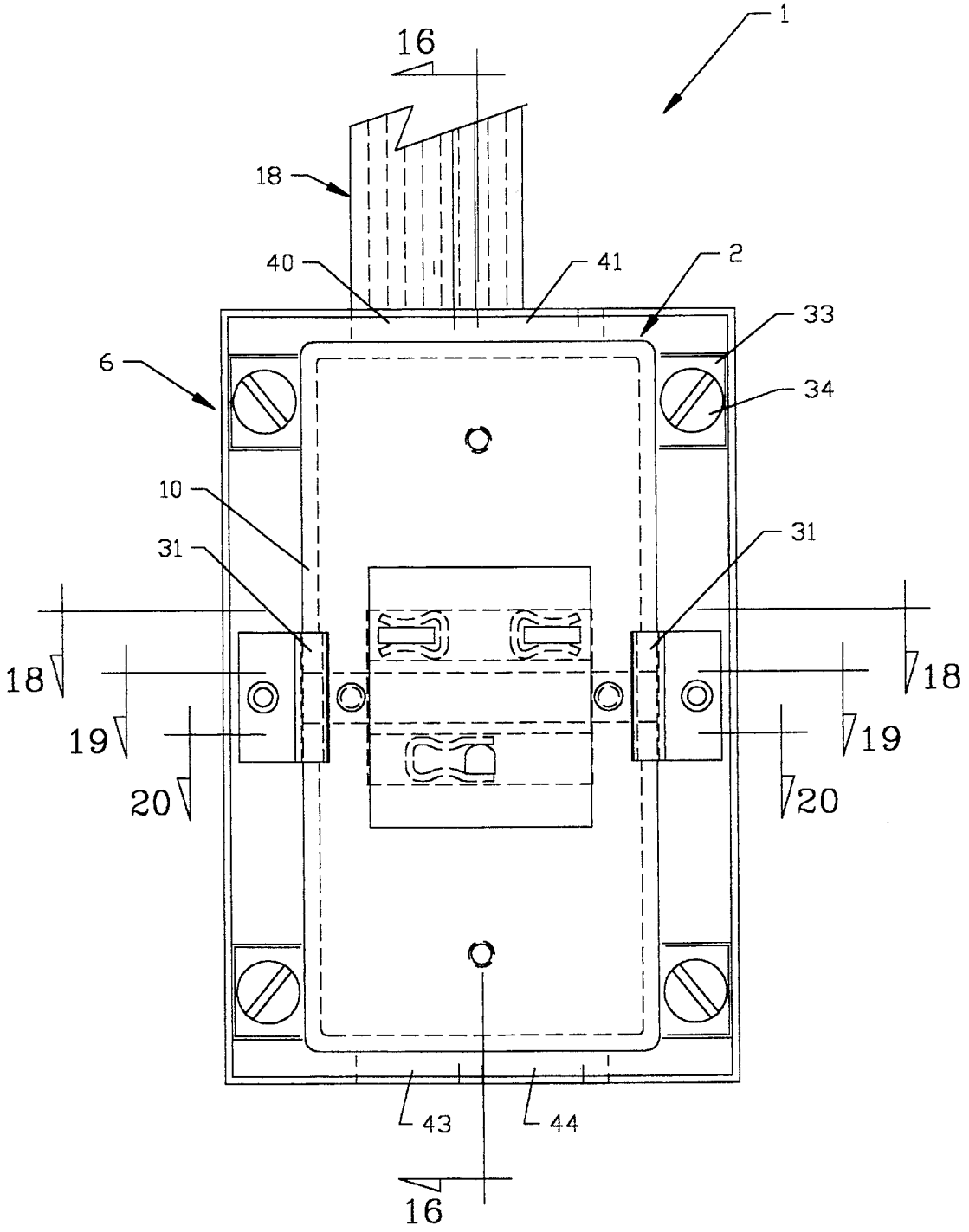
FIG. 15 is a front elevation view of the 240 volt receptacle module and 4-conductor cable installed in the wallbox.
Figure 16:
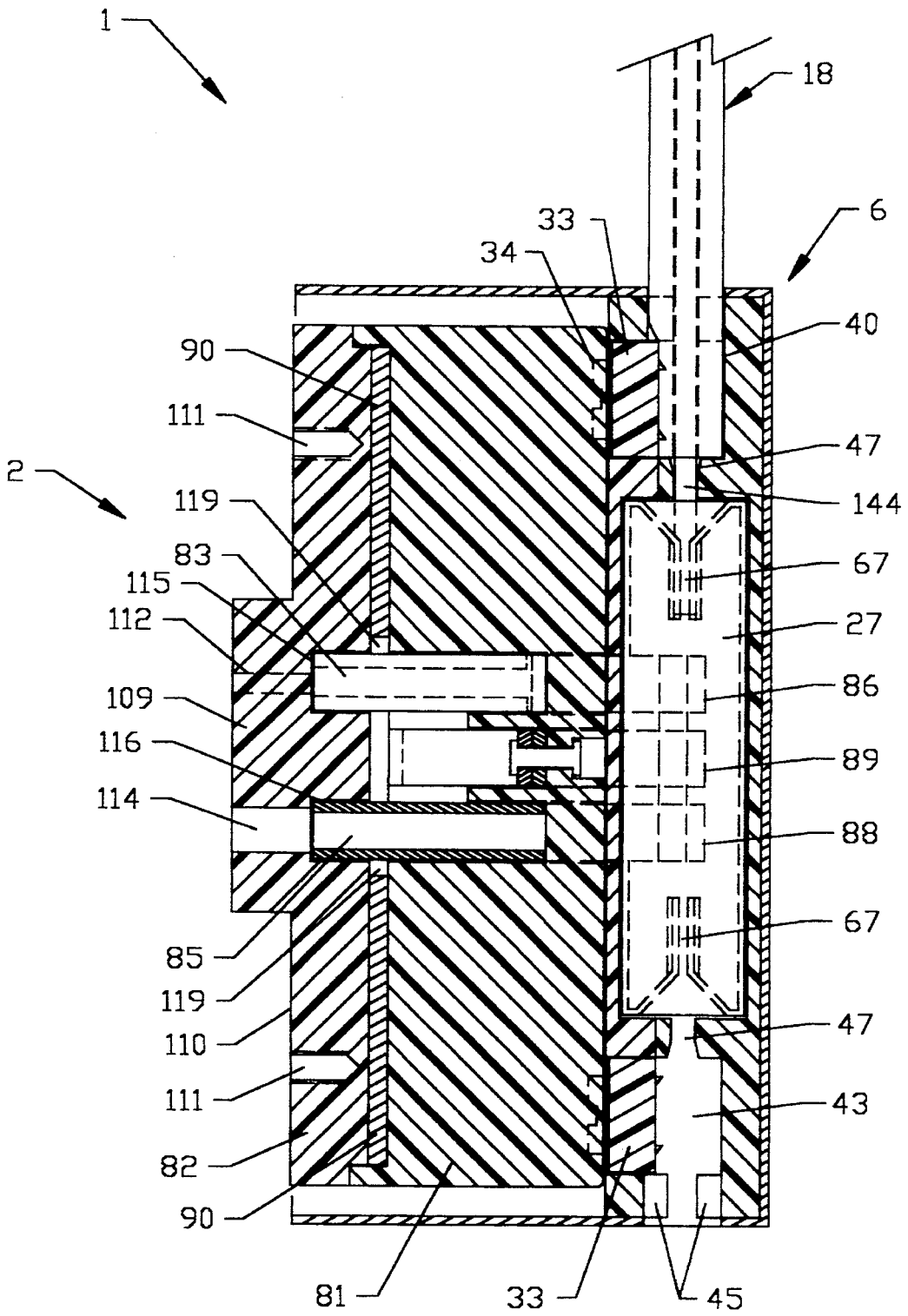
FIG. 16 is a vertical section view taken along line 16—16 of FIG. 15.

Referring to FIGS. 13 and 14, there is provided a 4-conductor cable 18. The cable sheath 141 is constructed of polyurethane, or otherwise a durable elastomer. The 4-conductor cable 18 contains three insulated wire conductors 142, 143, 145 and one ground wire conductor 144. The insulated wire conductors 142, 143, 145 are provided with an individual wire insulation sheath 146 for additional protection. The cable sheath 141 is extruded with two center-projection grooves 147 to provide a specific exterior profile. The wire conductors 142–145 are located in the cable sheath 141 relative to the specific exterior profile such that the 4-conductor cable 18 provides a slip-fit with the cable ports 39, 42 in the wiring module base 23 of the wallbox 6, as seen in FIG. 17.

Figure 17:
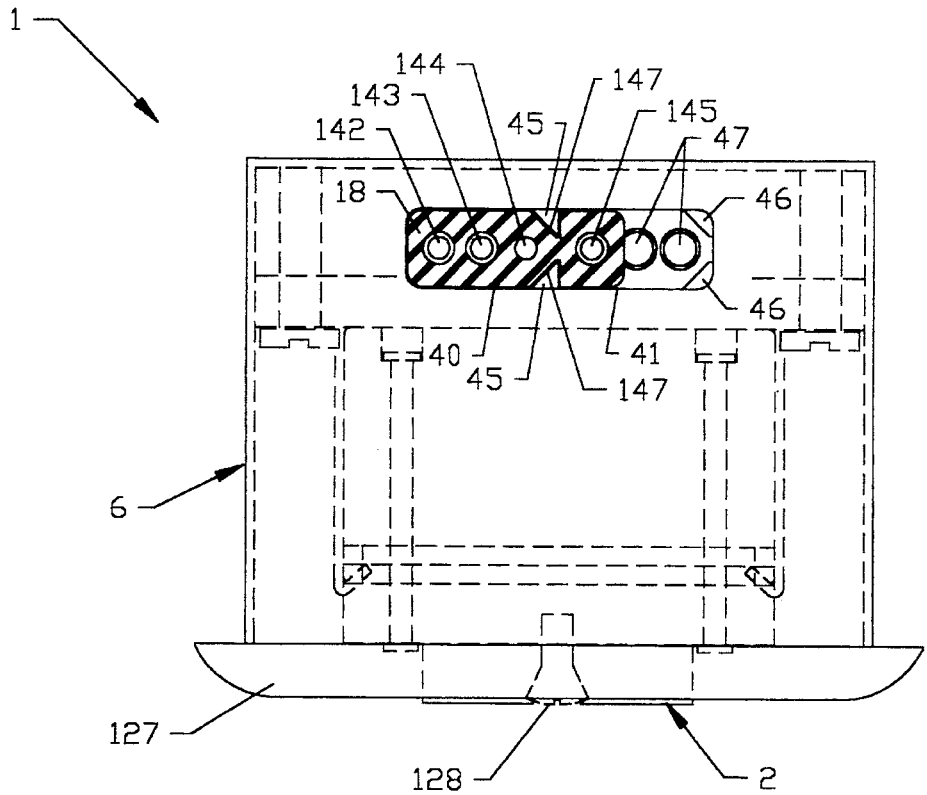
FIG. 17 is a plan view of the 240 volt receptacle module and 4-conductor cable installed in the wallbox.
Figure 17:
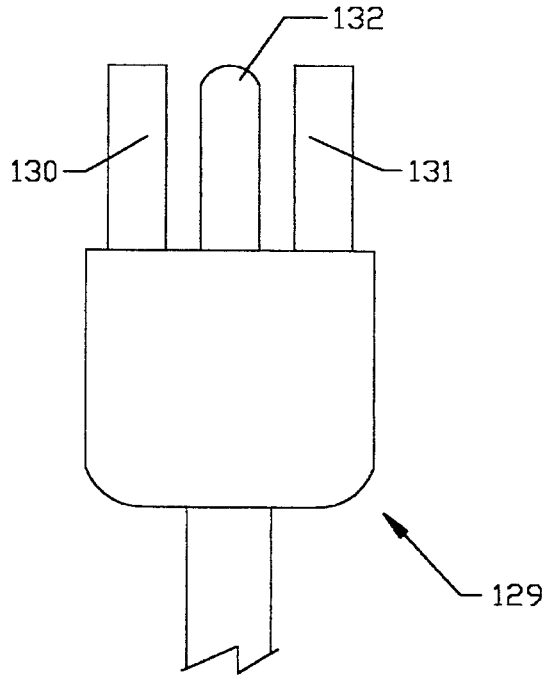

In operation, the present invention is illustrated in FIGS. 15 through 20, in which there is provided a 240 volt receptacle circuit 1. The 240 volt receptacle circuit 1 is comprised of a wallbox 6, a 240 volt receptacle module 2, and a 4-conductor cable 18. The 4-conductor cable 18 provides 240 volt electrical power to the wallbox 6 and is shown inserted into the top cable port 39. The 240 volts is nominal and the actual voltage is dependent on the power source. The specific exterior profile of the 4-conductor cable 18 and the specific interior profile of the top cable port 39 permits connection in one orientation only, as seen in FIG. 17. The 4-conductor cable 18 may also be connected to the bottom cable port 42 in the same manner. Wire conductor-A 142 of the 4-conductor cable 18 serves as the left positive conductor, wire conductor-B 143 serves as the neutral conductor, wire conductor-C 144 serves as the ground conductor, and wire conductor-D 145 series as the right positive conductor. As the 4-conductor cable 18 is inserted into either the top cable port 39 or the bottom cable port 42, the four wires 142, 143, 144, 145 protrude through the wire entrance holes 47 of the wiring module base 23 and into the wire-pressure sockets 67 of the wire adapters 25, 26, 27, 28; with wire conductor-A 142 connected to wire adapter-A 25, wire conductor-B 143 connected to wire adapter-B 26, wire conductor-C 144 connected to wire adapter-C 27, and wire conductor-D 145 connected to wire adapter-D 28. The cable sheath 141 is stripped from the end of the 4-conductor cable 18 before being fully inserted into the cable port 28, 42 and secured by means of the cable clamp 33 and cable clamp screws 34.

Figure 18:
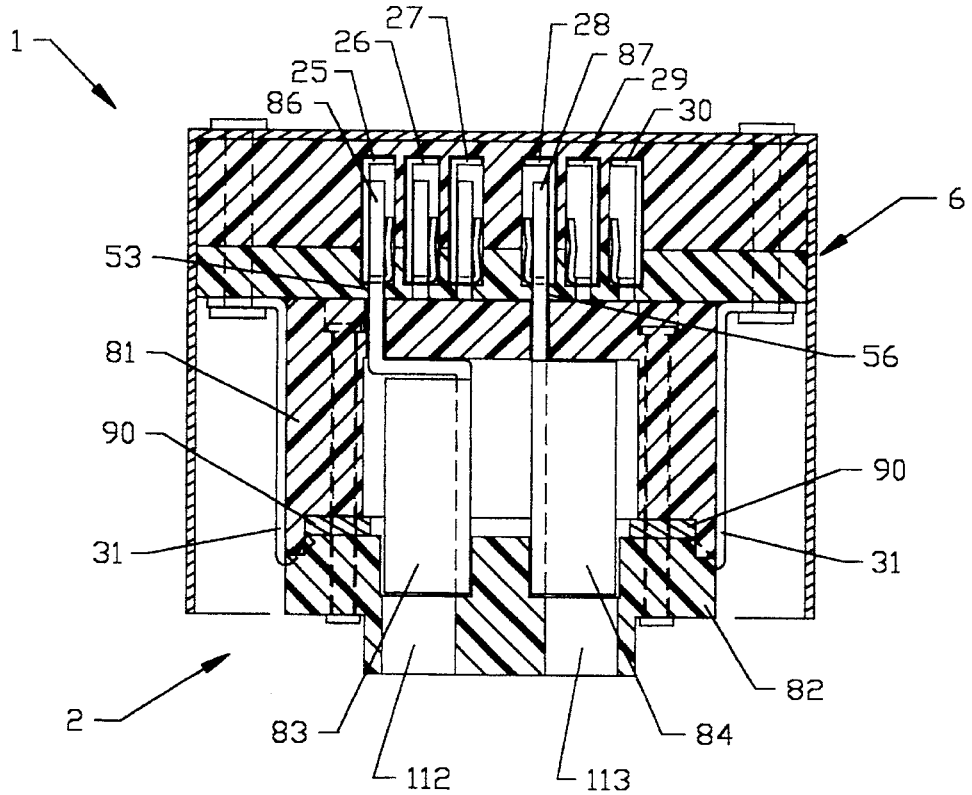
FIG. 18 is a horizontal section view taken along line 18—18 of FIG. 15.
Figure 18:
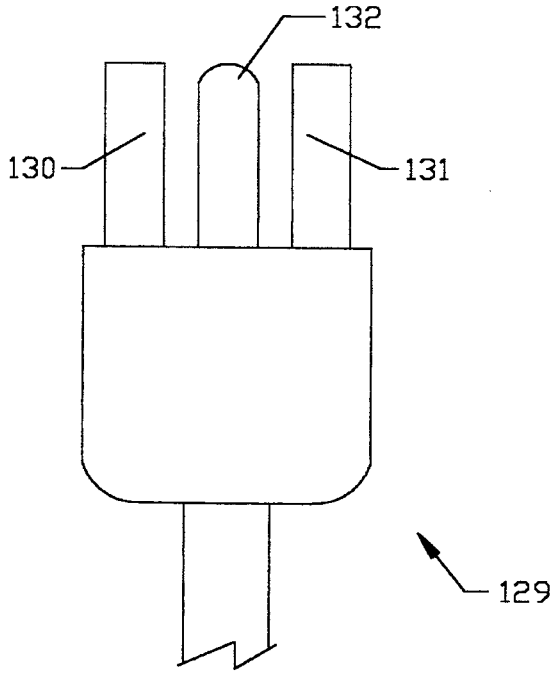

The 240 volt receptacle module 2 is inserted into the wallbox 6 until the spring clips 31 snap over the grounding plate 90 of the 240 volt receptacle module 2. As the 240 volt receptacle module 2 is inserted into the wallbox 6, the blade conductor 86 of the left positive plug adapter 83 protrudes through blade slot-A 53 of the wiring module cover 24 and into the blade-pressure socket 70 of wire adapter-A 25. The blade conductor 86 thereby connects wire adapter-A 25 to the left positive plug adapter 83, as seen in FIG. 18.

Likewise, as the 240 volt receptacle module 2 is inserted into the wallbox 6, the blade conductor 87 of the right positive plug adapter 84 protrudes through blade slot-D 56 of the wiring module cover 24 and into the blade-pressure socket 70 of wire adapter-D 28. The blade conductor 87 thereby connects wire adapter-D 28 to the right positive plug adapter 84, as seen in FIG. 18.

Figure 20:
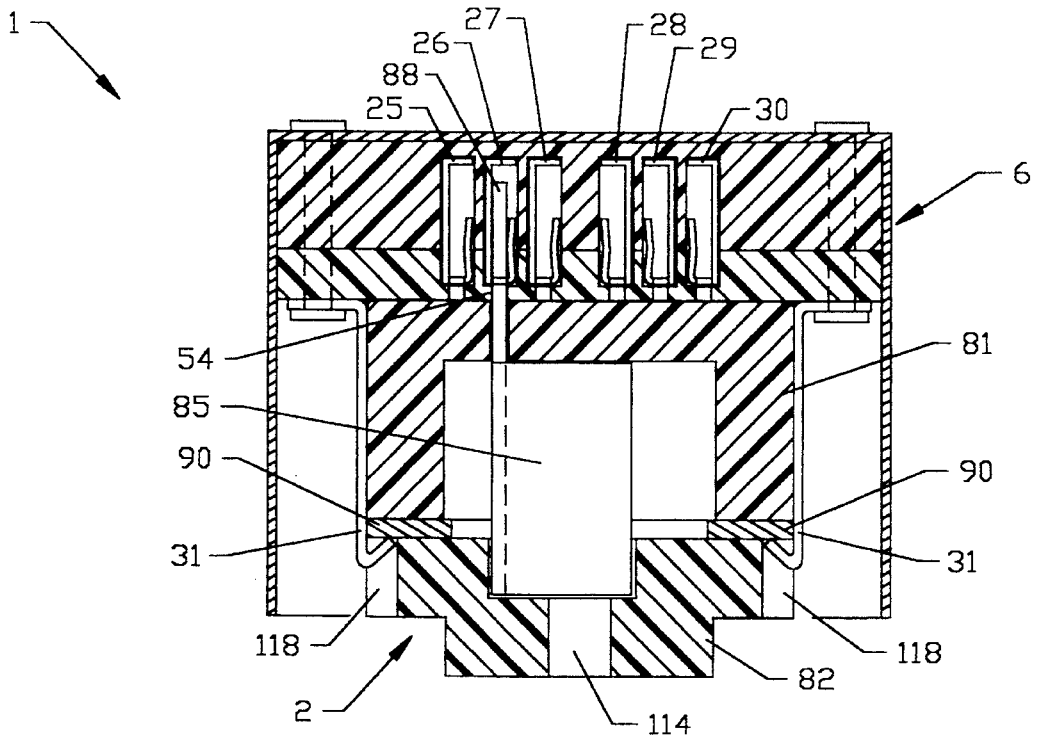
FIG. 20 is a horizontal section view taken along line 20—20 of FIG. 15.
Figure 20:
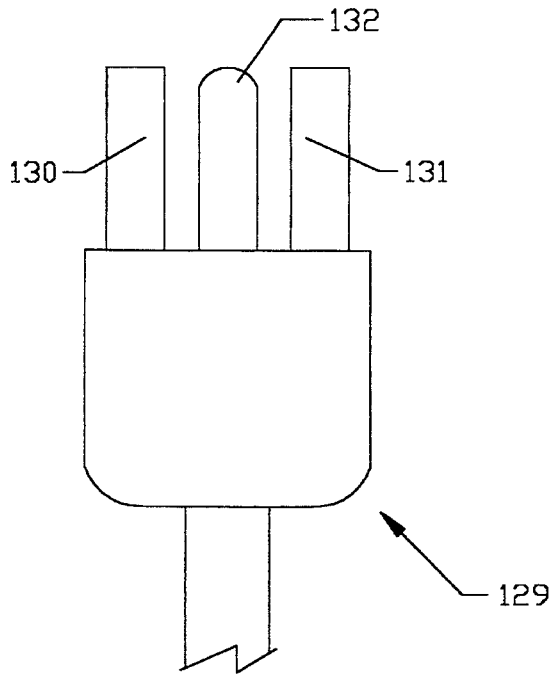

Likewise, as the 240 volt receptacle module 2 is inserted into the wallbox 6, the blade conductor 88 of the neutral plug adapter 85 protrudes through blade slot-B 54 of the wiring module cover 24 and into the blade-pressure socket 70 of wire adapter-B 26. The blade conductor 88 thereby connects wire adapter-B 26 to the neutral plug adapter 85, as seen in FIG. 20.

Figure 19:
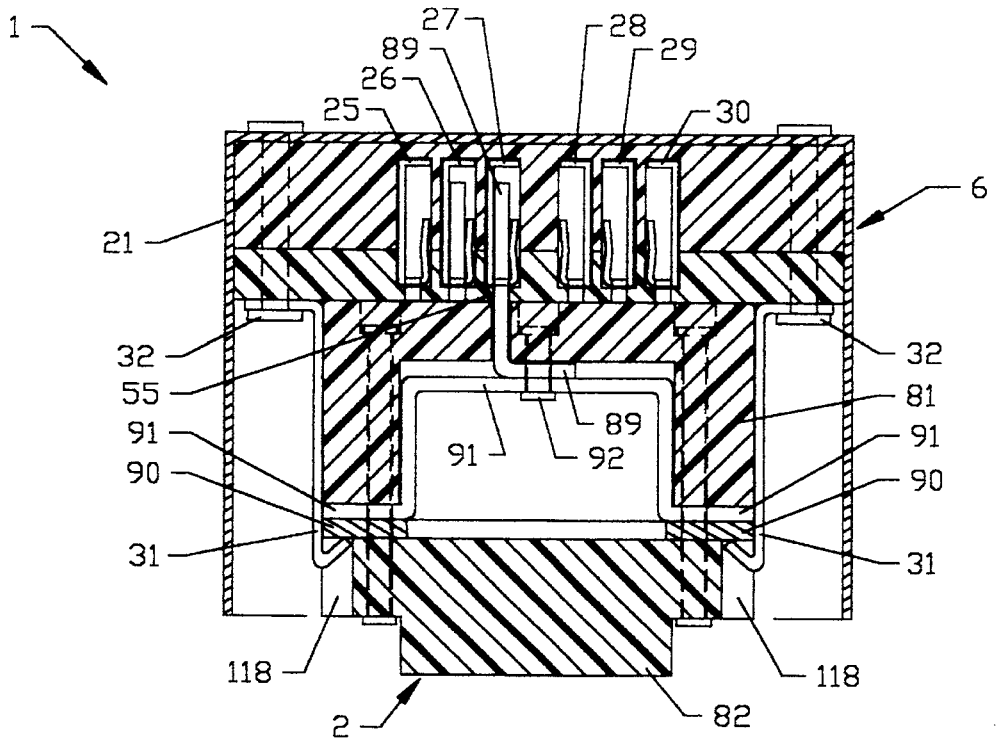
FIG. 19 is a horizontal section view taken along line 19—19 of FIG. 15.
Figure 19:
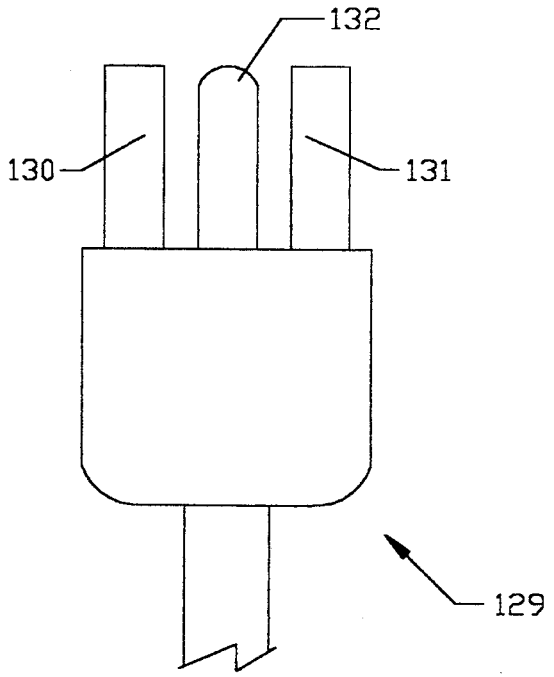

Also, as the 240 volt receptacle module 2 is inserted into the wallbox 6, the ground blade conductor 89 protrudes through blade slot-C 55 of the wiring module cover 24 and into the blade-pressure socket 70 of wire adapter-C 27. The ground blade conductor 89 thereby connects wire adapter-C 27 to the grounding bar 91, as seen in FIG. 19. The grounding bar 91 is connected to the grounding plate 90 which is in contact with the spring clips 31. The spring clips 31 are connected to the electrical box 21 by means of the rivets 32, thereby grounding the electrical box 21.

Functionally, it can be seen from the foregoing discussion that the assembly of the electrical components 2, 6, 18, in itself, self-configures the receptacle circuit and self-distributes a dedicated earth ground to the components. The electrical power is supplied to the wallbox 6 by means of a 4-conductor cable 18 connected to the top cable port 39. Continuity is provided between the left positive plug adapter 83 of the 240 volt receptacle module 2 and wire conductor-A 142 of the 4-conductor cable 18; between the neutral plug adapter 85 and wire conductor-B 143; between the grounding plate 90 and wire conductor-C 144; and between the right positive plug adapter 84 and wire conductor-D 145. When a standard electrical plug 129 is inserted into the receptacle face 109 of the 240 volt receptacle module 2, the left positive blade 130 of the electrical plug 129 is inserted into the left positive plug adapter 83 and the right positive blade 131 is inserted into the right positive plug adapter 84, thereby providing the electrical plug 135 with two positive conductors. Likewise, the neutral blade 132 of the electrical plug 129 is inserted into the neutral plug adapter 85, thereby providing the electrical plug 129 with a neutral conductor. It can also be seen that continuity is provided between wire conductor-C 144 of the 4-conductor cable 18 and the grounding plate 90 of the 240 volt receptacle module 2 as well as the electrical box 21, thereby grounding the 240 volt receptacle module 2 and the electrical box 21. A wallplate 127 is mounted to the 240 volt receptacle module 2 with two mounting screws 128.

The present invention may be provided in other modified forms without departing from the spirit and scope of the invention. The foregoing description is provided to illustrate one embodiment of the invention for purposes of this disclosure and it is intended to cover all changes and modifications which do not depart from the spirit and scope of this invention.

What is claimed is:

1. A 240 volt receptacle module adapted with four blade conductors protruding from said 240 volt receptacle module; with one blade conductor serving as a left positive blade conductor and internally connected to a left positive plug adapter, with one blade conductor serving as a right positive blade conductor and internally connected to a right positive plug adapter, with one blade conductor serving as a neutral blade conductor and internally connected to a neutral plug adapter, and with one blade conductor serving as a ground blade conductor and internally connected to a grounding plate, said blade conductors providing an electrical interface of said 240 volt receptacle module with a wallbox; said wallbox being adapted with the means to connect conductors of a 4-conductor cable to said blade conductors of said 240 volt receptacle module; said 240 volt receptacle module being comprised of:

a.) a module base which houses said plug adapters, b.) a module cover which retains said plug adapters in said module base and provides a receptacle face to interface with a standard 240 volt electrical plug, c.) said left positive plug adapter providing the electrical interface to the left positive blade of a standard 240 volt electrical plug, d.) said right positive plug adapter providing the electrical interface to the right positive blade of a standard 240 volt electrical plug, e.) said neutral plug adapter providing the electrical interface to the neutral blade of a standard 240 volt electrical plug, and f.) said grounding plate providing the means to ground said 240 volt receptacle module and the electrical box of said wallbox.

2. The 240 volt receptacle assembly of claim 1, wherein said grounding plate is connected to said ground blade conductor by means of a grounding bar; said grounding plate providing a contact surface to interface with the spring clips of said wallbox, thereby providing the means to connect the electrical box of said wallbox to the dedicated earth ground.

3. The 240 volt receptacle assembly of claim 1 wherein the installation of said 240 volt receptacle module and said 4-conductor cable into said wallbox, in itself, self-configures the 240 volt receptacle circuit and self distributes a dedicated earth-ground throughout said 240 volt receptacle circuit with said earth-ground being connected to said 240 volt receptacle module and to the electrical box of said wallbox; said 4-conductor cable providing two wire-conductors to serve as positive conductors, one wire-conductor to serve as a neutral conductor, and one wire-conductor to serve as a ground conductor.

4. The 240 volt receptacle assembly of claim 3 wherein the self-distribution of the dedicated earth ground and the self-configuration of the 240 volt receptacle circuit is assisted with said 4-conductor cable being provided with a specific exterior profile; and each cable port of said wallbox being provided with a specific interior profile; said specific exterior profile of said 4-conductor cable and said specific interior profile of the cable ports permit connection of said cables into said cable ports in one orientation only, thereby insuring the proper configuration of the electrical circuit and the connection of said ground wire conductor to the proper components.

5. The 240 volt receptacle assembly of claim 4 wherein said specific exterior profile of said 4-conductor cable consists of a rectangular shape with one center-projection groove in each of the long sides of said rectangular shape.

* * * * *